United States Patent [19]

Baghdadi

[11] Patent Number: 4,658,483

[45] Date of Patent: Apr. 21, 1987

[54] YARN SHRINKING METHOD

[76] Inventor: George L. Baghdadi, 28 Geraldine Ct., Don Mills, Ontario M3A 1M9, Canada

[21] Appl. No.: 727,679

[22] Filed: Apr. 26, 1985

[51] Int. Cl.[4] ..... D02J 1/22

[52] U.S. Cl. ..... 28/219; 28/281

[58] Field of Search ..... 28/219, 281; 26/18.5

[56] References Cited

U.S. PATENT DOCUMENTS

| | | | |
|---|---|---|---|
| 2,338,983 | 1/1944 | Thackston et al. . | |
| 2,669,002 | 2/1954 | Dalton et al. . | |
| 3,646,744 | 3/1972 | Rusca | 28/281 X |
| 3,664,158 | 5/1972 | Skaathun et al. . | |
| 3,695,064 | 10/1972 | Runton . | |
| 3,763,669 | 10/1973 | Bous et al. | 28/281 X |
| 4,059,974 | 11/1977 | Fleissner . | |
| 4,207,730 | 6/1980 | Lorenz | 28/281 X |

FOREIGN PATENT DOCUMENTS

| | | | |
|---|---|---|---|
| 738983 | 10/1955 | United Kingdom | 26/18.5 |

*Primary Examiner*—Robert R. Mackey

*Attorney, Agent, or Firm*—George A. Rolston

[57] ABSTRACT

Apparatus for shrinking thread having a spool with a speed control, a liquid tank and rollers for guiding thread into and out of the tank, a drive for drawing the thread off the spool and through the tank, a drying chamber, and rollers in the chamber for guiding the thread, a tension releaser between the drying chamber and the drive to relax tension in the thread, a thread wind-up, a speed sensor for sensing the speed of the thread, and, a process control connected to the speed sensor, and to the drive, and to the speed control to control their operation.

3 Claims, 3 Drawing Figures

YARN SHRINKING METHOD

The invention relates to apparatus for shrinking thread, and a method of shrinking.

BACKGROUND OF THE INVENTION

Natural fibers such as cotton, are subject to shrinkage as a result of washing and drying. Natural fiber thread, when used for the sewing of clothing and other articles is also liable to shrinkage. Accordingly, proposals have been made in the past for shrinking natural fibers both in the form of thread and when woven into fabrics.

Ideally, it would be possible to preshrink both the fabric and the thread so that no further shrinkage of any kind could take place.

In practice however it is well known that this cannot be achieved. Many manufacturers guarantee their products against shrinkage but in practice, experience leads to the conclusion that some degree of residual shrinkage will always take place, as a result of laundering.

In addition, the amount of shrinkage is not always equalized as between the fabric and the thread. Fabric which has been preshrunk, and is then sewn using a preshrunk or partially shrunk natural fiber thread, is usually subjected to laundering many times during use. As a result of laundering, further residual shrinkage takes place.

It is found that in many cases the thread is liable to shrink somewhat more than the fabric. In addition, the thread will invariably shrink along its length. Since the thread is passed repeatedly through the fabric, during sewing, the length of thread used to sew a particular seam, will be much greater than the length of the seam. Since the degree of shrinkage is dependent on the length of the thread, and where shrinkage of the thread and fabric take place as a result of laundering, it will be apparent that the actual length of shrinkage of the thread will be greater than actual length of shrinkage of fabric. As a result, this can cause creases or puckers in the fabric, caused by the increase in tension in the thread as a result of the shrinkage taking place.

One of the problems in the preshrinking of thread is that, for reasons of economy, the preshrinkage operation must be carried out on a continuous basis. If the thread is, for example, unwound from a spool, and is wound up on another spool, some degree of tension is liable to occur in the thread, which tension will tend to resist shrinking.

This is highly undesirable, since clearly in the preshrinking operation it is desirable to permit as much shrinkage as possible.

Another problem is, of course, the fact that during the sewing operation, considerable tension is applied to thread, which may in fact cause a slight increase in length. Any resultant further shrinking of the thread as a result of washing and drying, will thus be immediately noticeable as it causes creases or puckers in the fabric.

Clearly, it would be desirable if possible to allow some form of elasticity in the thread which would at the same time allow for the sewing operation to be carried out with the thread at the appropriate tension, and at the same time allow some degree of relaxation in the thread which would compensate for subsequent shrinkage during washing.

Further problems arise in regulating the preshrinking operation, to account for variations in thread content and fiber, and in regulating process conditions.

BRIEF SUMMARY OF THE INVENTION

With a view to overcoming these various disadvantages, the invention comprises an apparatus for shrinking thread having a thread supply spool for unwinding thread, speed control means for adjustably controlling the unwind speed of the thread, a liquid tank, and rollers for guiding the thread from the spool into and out of the tank, drive means for engaging the thread and drawing the same off the unwind spool and through the tank, drying chamber means, and rollers in said drying chamber means for guiding said thread through said drying chamber means, tension releasing means between said drying chamber and said drive means, whereby to relax tension in said thread at the entry to said drying chamber, thread wind up means adjacent the exit from said drying chamber, and speed sensing means for sensing the speed of the thread adjacent said exit, and, process control means connected to said speed sensing device, and to said thread drive means, and to said speed control means, whereby to adjust and control the operation thereof, to relax tension in said thread.

More particularly, it is an objective of the invention to provide such an apparatus wherein the thread is formed into a loop of adjustable length, and including sensing means for sensing the length of the loop, said sensing means being connected to said process control means, whereby to cause the same to vary the operation of the thread drive means or said speed control means or both, to maintain the size of the loop within predetermined limits.

More particularly, it is an objective of the invention to provide apparatus having the foregoing advantages including moisture sensing means for sensing the moisture content of the thread, as it exits from the drying chamber, and means for controlling the rate of drying in said chamber, whereby to insure that the thread has a predetermined moisture content after drying.

More particularly, it is an objective of the invention to provide apparatus having the foregoing advantages including further moisture sensing means adjacent to the path of the thread before and after it enters the water tank.

More particularly, it is an objective of the invention to provide apparatus having the foregoing advantages incorporating air circulating means and heating means, for providing a drying atmosphere in the drying chamber, and including control means for controlling the input of heat, said control means being connected to said process control means, and being variable in response to a signal therefrom.

More particularly, it is an objective of the invention to provide a second liquid tank, and drying chamber arranged in tandem, for providing a secondary treatment of the thread.

It is a further and related objective of the invention to provide a method of preshrinking thread comprising the steps of continuously unwinding thread from an unwind spool, variably controlling the speed of unwinding, passing said thread through a tank containing a liquid, to wet the thread, passing said thread through a thread drive means whereby to draw the thread off the unwind spool and through the tank, passing the thread from the thread drive means through a drying chamber, whereby to dry off moisture, and procure shrinking, and continuously winding said thread up on a wind up spool, and treating said thread in a solution of a shrink enhancing chemical, said chemical being water soluble, whereby the same may be subsequently washed out during laundering.

More particularly the invention provides a method having the foregoing advantages, including the steps of passing the thread through a second tank, and a second drying chamber, and wherein said second tank contains a liquid solution of said shrink enhancing chemical.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
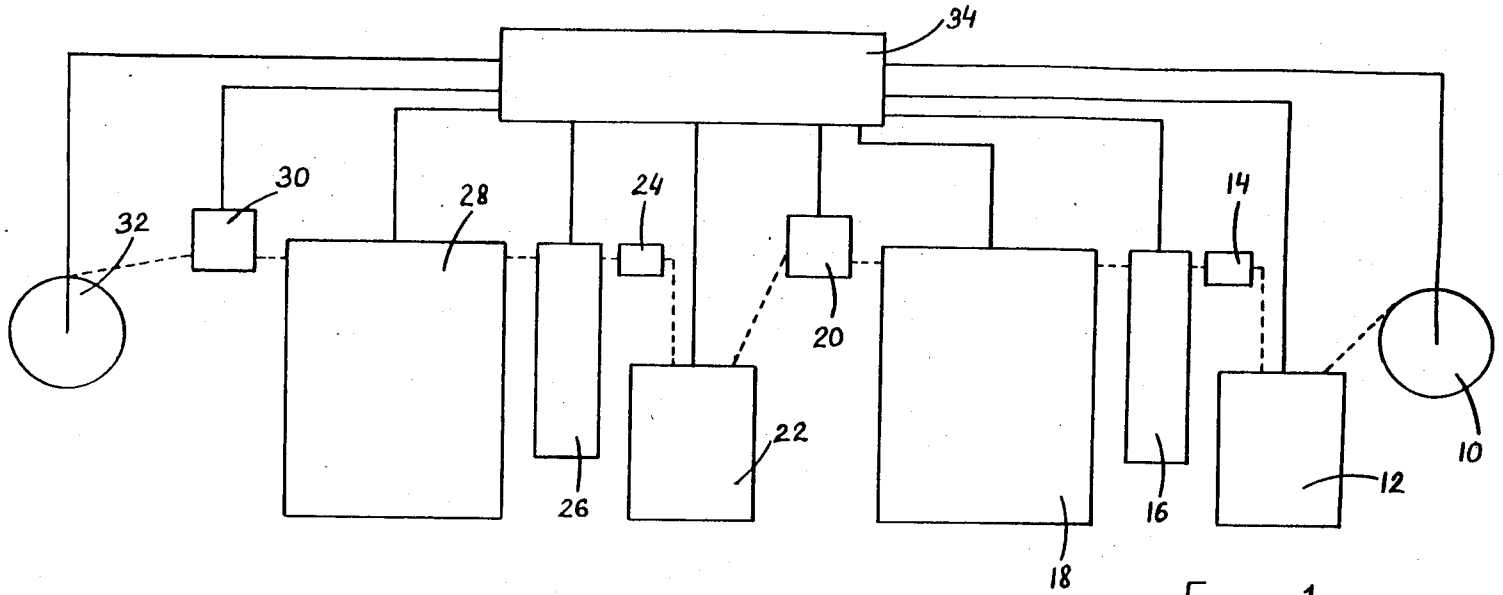
FIG. 1 is a schematic illustration of the method.

Referring first of all to FIG. 1, the apparatus according to the invention is illustrated schematically for the sake of obtaining an understanding of the general layout of the apparatus, and the operation of the method.

As shown in FIG. 1, the thread T proceeds from right to left. Thus an unwind spool 10 is provided for storing thread and unwinding. Spool 10 has a brake means (not shown) for controlling its unwind speed.

From the unwind spool 10, the thread passes to a tank 12 containing a hot liquid which is typically water, at a temperature just below the boiling point. Tank 12 will typically have a heater (not shown) controlling the water temperature in any suitable manner, and some form of heater control. Typically guides of some kind will be provided for guiding the thread into and out of the water in tank 12.

From tank 12 the thread passes through a controllable thread drive 14, and the thread then passes to the tension releasing device 16. The tension releasing device 16 will typically provide a free loop of thread, so that there is a minimum tension at that point, in the thread.

The thread then passes to the drying chamber 18. The drying chamber 18 will typically be heated, and will have a controlable atmosphere, and means will be provided with for procuring atmospheric flow in the chamber. The thread then passes to a further drive 20, which is also controllable so as to draw the thread through the chamber 18, with a minimum of tension.

From the drive 20, the thread passes to a further tank 22. Tank 22 will typically contain a further quantity of heated liquid. In this case, the liquid will contain a solution of a shrink enhancing chemical.

Guides (not shown) in the tank will cause the thread to be immersed in the solution.

From the tank 22, the thread will pass to a further drive 24 which is controllable, and will then enter a tension releasing device 26 similar to the device 16.

The thread will then enter drying chamber 28 similar to drying chamber 18, and will then pass through a further drive 30 similar to the drive 20, and finally to the wind up spool 32.

Various functions of the different components and assemblies will typically be controlled by a central process controller 34, connected to the various units.

Figure 2:
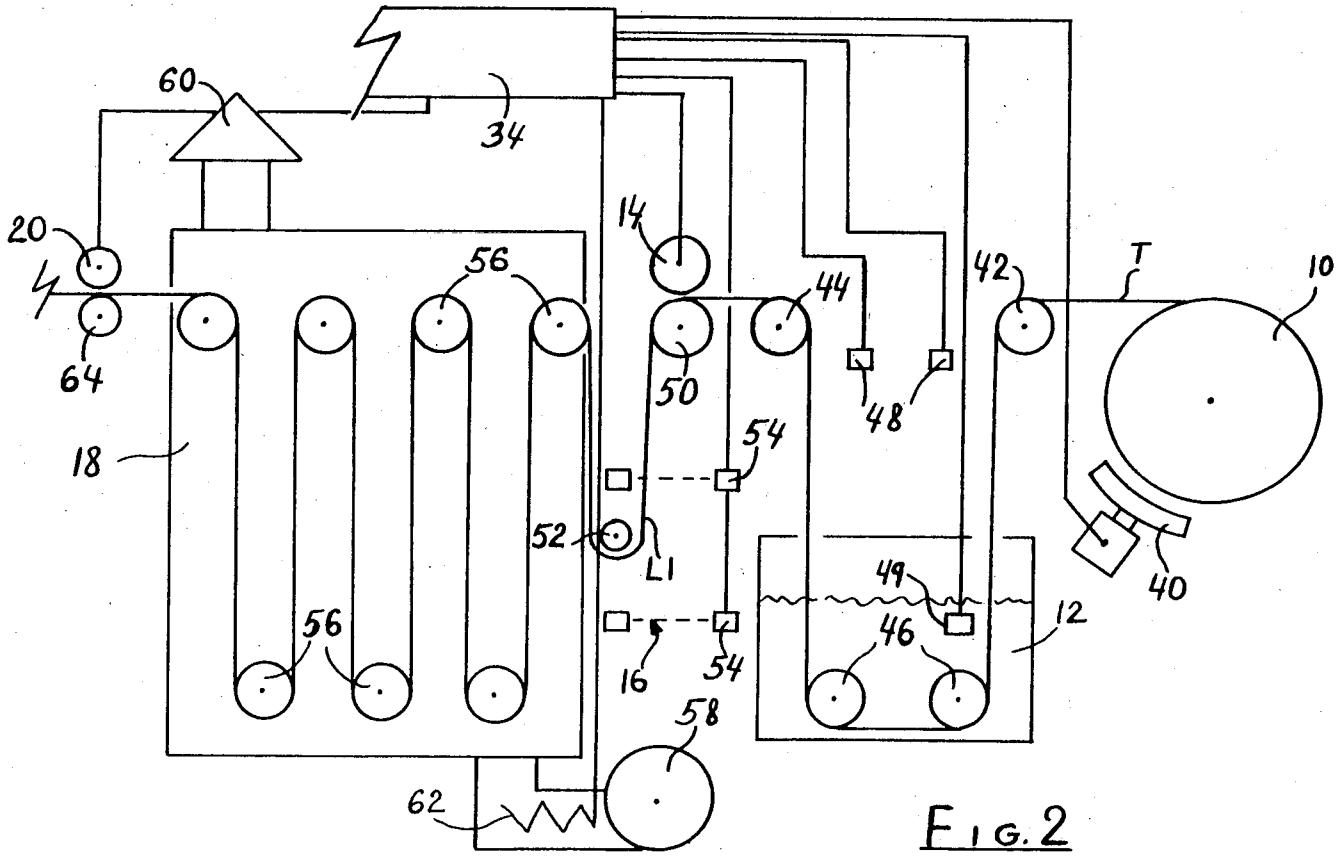
FIG. 2 is a schematic illustration of a first portion of the apparatus.
Figure 3:
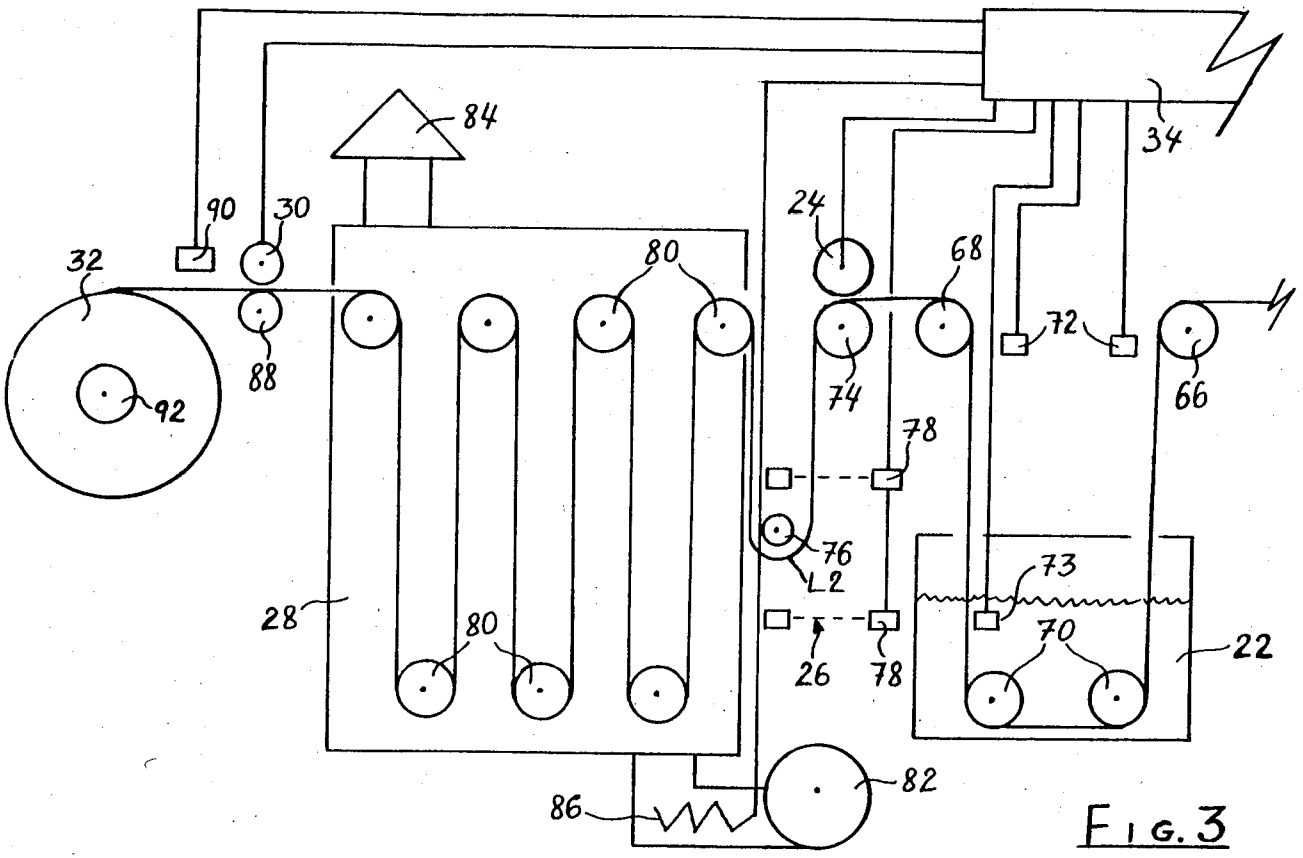
FIG. 3 is a schematic illustration of a second portion of the apparatus.

Referring now to FIGS. 2 and 3, the apparatus will be described in more detail. FIG. 2 illustrates the first stage of the apparatus, that is to say from the unwind roll 10, to just downstream of the drive 20. FIG. 3 represents the second stage of the apparatus, from the thread drive 20, to the windup roll 32.

It will be noted that the process control unit 34 is partially illustrated in both FIGS. 2 and 3, for the sake of clarity.

Referring now to FIG. 2, it will be seen that the unwind spool 10 is provided with a braking means indicated as 40, which is adjustably operable by any suitable means so as to provide a certain degree of tension to thread being unwound from the spool 10, merely to control unrestricted unspooling of the thread. Guide rollers 42 and 44 guide the thread into and out of the first tank 12, and further similar guide rollers 46 will be provided within the tank 12 for causing the thread to be continuously immersed in the liquid.

Preferably, in order to provide accurate control of the process, moisture sensors 48–48 are provided adjacent to the path of thread where it enters and leaves the tank, so as to continuously monitor the condition of the thread. Sensor 49 is located in tank 12 to monitor the temperature of the water. Both sensors 48 and 49 are connected to the process control unit 34.

From roller 44, the thread passes to the thread drive 14. Thread drive 14 is connected to the process controller 34. A pressure roll 50 is provided, for controlling the thread as it passes around the thread drive 14.

The thread then passes into the tension relaxing unit 16. This will comprise any suitable means for forming a free loop indicated generally as L1 in the thread. Any suitable guide roller 52 is provided in the tension releasing unit 16. This roller may be of ultra lightweight material such as plastic foam material or the like, and may be itself guided in any suitable manner so that it may ride up and down. Alternately, some form of air jet device may be employed to control the loop L1.

The height of the loop L1 is sensed by means of upper and lower sensing devices 54, which in this case are illustrated as photo cells. The photo cells 54 are connected to the process control 34, and are adapted to signal either that the loop L1 is too short or too long.

The thread then enters the drying chamber 18. Drying chamber 18 contains a number of rolls or guide means 56, so that the thread forms a series of sinusoidal loops in the chamber 18. The chamber 18 is preferably provided with some form of atmospheric circulation system such as the fan 58, and the vent 60.

Heating means 62 may be provided, controlled by the process control 34.

From chamber 18, the thread then passes through a further thread drive 20, passing over guide roller 64.

Drive 20 is connected to and controlled by process control 34, and is operated at such a speed that the loop L1 is intended to remain substantially between the two photo cells 54.

In this way, the thread is drawn through the chamber 18, while being subjected to a minimum of tension. The speed of drive 20 will be somewhat less than the speed of drive 14, so as to allow for the continuous degree of shrinkage which will take place along the length of the thread, in chamber 18.

Turning now to FIG. 3, it will be seen that the thread then passes into and out of tank 22 over guide rollers 66 and 68. Further guide rollers 70 are located in the tank 22 to ensure that the thread is continuously immersed. Moisture sensors 72 are located adjacent the rollers 66 and 68. Sensor 73 is located in tank 22, and both sensors 72 and 73 are connected to process control 34.

A further thread drive 24 is located adjacent the guide roller 68, and a further guide roller 74 is provided to control the thread at this point. Thread drive 24 is also connected to the process control 34.

A further tension releasing unit 26 is provided, consisting essentially of any means for forming a free loop L2 in the thread.

Any suitable thread control such as an ultra light-weight roll 76 may be provided. Upper and lower photo cells 78 are provided, being connected to the process control 34, intended to control the upper and lower limits of the loop L2.

The thread then passes into the second drying chamber 28, passing around guide rolls 80, to form loops.

The atmosphere in chamber 28 is controlled by means such as a fan 82 and vent 84, and air heater 86 connected to process control 34.

The thread then passes from chamber 28 to the further thread drive 30, passing over guide roll 88 in the process. Moisture sensor 90 may be provided, as shown in FIG. 3, also connected to process control 34.

The windup spool 32 may also be driven by any suitable drive means indicated as 92, connected to the process control 34.

In operation, thread passes from the right hand side of FIG. 2 to the left hand side of FIG. 3 continuously.

The first tank 12 contains hot water.

The second tank 22 contains hot water, in which is also mixed a solution of a shrink enhancing chemical. Typically, such shrink enhancing chemical may be aluminum sulphate, or some other such chemical which is known to assist in enhancing shrinkage. Typically, the solution of aluminum sulphate in water may be approximately 3 to 5 per cent by weight.

It is the property of such a chemical solution that when the thread is passed through it, it will procure a further temporary shrinkage, i.e., it will "enhance" the shrinkage that takes place.

However, once the thread is subsequently sewn into a garment and washed, and the chemical is removed, the thread will relax again and increase slightly in length.

The thread passes first into the plain water tank 12, then into the drying chamber 18. This produces the primary shrinkage.

In order to accommodate this, the drive 20 is run somewhat slower than the drive 14. The precise difference between the two speeds is controlled by process controller 34.

At the same time, the condition of the thread that enters and leaves the tank is monitored by moisture sensors. The information collected from the moisture sensors will be of assistance in controlling the operation of the brake 40, and the thread drive 14, and the drying chamber 18.

The wetting in tank 12 and drying in chamber 18 will procure a first or primary shrinkage.

Normally, the drive 20 will be found somewhat slower than the drive 14, so as to maintain the tension in the thread in the chamber 18, substantially at a minimum. This speed control function is governed by controller 34.

When the thread passes through the second tank 22 and second drying chamber 28, it is treated not merely to a further wetting with water, but to an immersion in the shrink enhancing chemical solution in water.

This produces a secondary shrinkage, due to the action of the shrink enhancing chemical solution.

Upon drying in chamber 28, the secondary shrinkage in the thread is temporarily set, allowing the thread to be wound up and used for sewing.

When the thread is used to manufacture a fabric article, typically clothing, the first washing of the clothing by the purchaser will wash out the water soluble shrink enhancing chemical, and allow the thread to relax and extend slightly in length.

By the use of the invention, therefore, it is possible to build in a certain degree of elasticity into the thread.

As the garment is subsequently re-washed, a further limited degree of shrinkage takes place in the thread due to the further repeated washings. However, since the thread is relaxed, it will not become overtensioned in the fabric and thus avoids causing distortions or puckering in the article.

Having described what is believed to be the best mode by which the invention may be performed, it will be seen that the invention may be particularly defined as follows:

Apparatus for shrinking thread comprising a thread supply spool for unwinding thread, speed control means for adjustably controlling the unwind speed of the thread, liquid tank means, and rollers for guiding said thread from said spool into and out of the tank means, drive means for engaging said thread and drawing the same off said unwind spool and through said tank means, drying chamber means, and rollers in said drying chamber means for guiding said thread through said drying chamber means, tension releasing means between said drying chamber means and said drive means whereby to relax tension in said thread at the entry to said drying chamber means, thread wind-up means adjacent the exit from said drying chamber means, speed sensing means for sensing the speed of said thread adjacent said exit, and, process control means connected to said speed sensing means, and to said thread drive means, and to said speed control means whereby to control the operation thereof, to relax tension in said thread, and further connected to said liquid tank means and said drying chamber means, for controlling conditions therein.

The foregoing is a description of a preferred embodiment of the invention which is given here by way of example only. The invention is not to be taken as limited to any of the specific features as described, but comprehends all such variations thereof as come within the scope of the appended claims.

What I claim is:

1. A method for twice shrinking thread and temporarily setting it in its twice shrunk condition and comprising the steps of passing thread continuously through a tank means containing a liquid, thereafter passing said thread through tension releasing means, and thereafter passing said thread through drying chamber means, whereby said thread is dried, and is simultaneously permitted to shrink a first time along its length into a first-shrunk condition, without being subjected to tension, passing said thread through second liquid tank means containing a liquid solution of a water soluble temporary shrink-enhancing and setting compound, said compound being removable by a subsequent washing step, passing said thread through tension releasing means, and thereafter passing said thread through drying chamber means whereby said thread is permitted to shrink a second time to a twice-shrunk condition, and whereby said shrink-setting compound is dried in said thread thereby temporarily setting and retaining said thread in its said twice-shrunk condition until said shrink-setting compound is removed in a subsequent washing, thereby releasing said thread to its said first-shrunk condition.

2. The method as claimed in claim 1 wherein the step of releasing the tension in said thread comprises forming said thread into a free loop, passing said thread through said drying step, and passing said thread through thread drive means downstream of said drying step, and sensing the size of said free loop of said thread, and controlling said speed of said thread drive means, to maintain said loop within predetermined size limits.

3. The method as claimed in claim 1 wherein said shrink enhancing and setting compound is water soluble aluminum sulphate.

* * * * *